US011260667B2

(12) United States Patent
Uematsu et al.

(10) Patent No.: US 11,260,667 B2
(45) Date of Patent: Mar. 1, 2022

(54) LIQUID CIRCULATION DEVICE, LIQUID DISCHARGE APPARATUS, AND LIQUID CIRCULATION METHOD

(71) Applicants: Yuuichiroh Uematsu, Kanagawa (JP); Ryohki Wakasa, Kanagawa (JP); Atsushi Mori, Tokyo (JP)

(72) Inventors: Yuuichiroh Uematsu, Kanagawa (JP); Ryohki Wakasa, Kanagawa (JP); Atsushi Mori, Tokyo (JP)

(73) Assignee: RICOH COMPANY LTD., Tokyo (JP)

( * ) Notice: Subject to any disclaimer, the term of this patent is extended or adjusted under 35 U.S.C. 154(b) by 0 days.

(21) Appl. No.: 16/869,914

(22) Filed: May 8, 2020

(65) Prior Publication Data

US 2020/0376842 A1 Dec. 3, 2020

(30) Foreign Application Priority Data

May 31, 2019 (JP) ..... JP2019-102584

(51) Int. Cl.

| | |
|---|---|
| ***B41J 2/18*** | (2006.01) |
| ***B41J 2/14*** | (2006.01) |
| *B41J 2/175* | (2006.01) |

(52) U.S. Cl.

CPC ..... *B41J 2/18* (2013.01); *B41J 2/14274* (2013.01); *B41J 2/14153* (2013.01); *B41J 2/17503* (2013.01); *B41J 2002/14354* (2013.01); *B41J 2202/12* (2013.01); *B41J 2202/20* (2013.01)

(58) Field of Classification Search

CPC ..... B41J 2/18; B41J 2/17503; B41J 2002/14354; B41J 2/14153; B41J 2202/12; B41J 2202/20; B41J 2/14274

See application file for complete search history.

(56) References Cited

U.S. PATENT DOCUMENTS 8,585,190 B2 * 11/2013 Hiratsuka ..... B41J 29/38 347/85

FOREIGN PATENT DOCUMENTS

| | | |
|---|---|---|
| JP | 2013-166308 | 8/2013 |
| JP | 2014-113816 | 6/2014 |

* cited by examiner

*Primary Examiner* — Geoffrey S Mruk

(74) *Attorney, Agent, or Firm* — Harness, Dickey & Pierce, P.L.C.

(57) ABSTRACT

A liquid circulation device includes a circulation passage, a liquid feeding device, a pressure sensor, and control circuitry. Through the circulation passage, liquid circulates to be supplied to and collected from a circulatory liquid discharge head. The liquid feeding device is configured to circulate the liquid through the circulation passage. The pressure sensor is configured to detect a pressure of the circulation passage. The control circuitry configured to acquire a characteristic indicating a relationship among a drive amount of the liquid feeding device, discharge information of the liquid discharged from the liquid discharge head, and a pressure detection value of the circulation passage; and change, based on the characteristic acquired, at least one of a control parameter and a calculation expression used to control the liquid feeding device.

9 Claims, 11 Drawing Sheets

LIQUID CIRCULATION DEVICE, LIQUID DISCHARGE APPARATUS, AND LIQUID CIRCULATION METHOD

CROSS-REFERENCE TO RELATED APPLICATION

This patent application is based on and claims priority pursuant to 35 U.S.C. § 119(a) to Japanese Patent Application No. 2019-102584, filed on May 31, 2019, in the Japan Patent Office, the entire disclosure of which is incorporated by reference herein.

BACKGROUND

Technical Field

Aspects of the present disclosure relate to a liquid circulation device, a liquid discharge apparatus, and a liquid circulation method.

Related Art

As one type of liquid discharge head (hereinafter also referred to simply as a "head"), a flow-through head (circulatory head) is known that includes supply channels communicating with individual liquid chambers, which communicate with nozzles, and collection channels communicating with the individual liquid chambers. The flow-through head further includes, for example, liquid supply ports communicating with the supply channels and liquid collection ports communicating with the collection channels.

SUMMARY

In an aspect of the present disclosure, there is provided a liquid circulation device that includes a circulation passage, a liquid feeding device, a pressure sensor, and control circuitry. Through the circulation passage, liquid circulates to be supplied to and collected from a circulatory liquid discharge head. The liquid feeding device is configured to circulate the liquid through the circulation passage. The pressure sensor is configured to detect a pressure of the circulation passage. The control circuitry configured to acquire a characteristic indicating a relationship among a drive amount of the liquid feeding device, discharge information of the liquid discharged from the liquid discharge head, and a pressure detection value of the circulation passage; and change, based on the characteristic acquired, at least one of a control parameter and a calculation expression used to control the liquid feeding device.

In another aspect of the present disclosure, there is provided a liquid discharge apparatus that includes the liquid circulation device and the liquid discharge head.

In still another aspect of the present disclosure, there is provided a liquid circulation method that includes detecting, controlling, acquiring, and changing. The detecting detects a pressure in a circulation passage through which liquid circulates to be supplied to and collected from a circulatory liquid discharge head. The controlling controls a liquid feeding device based on a detection result of the pressure to circulate the liquid in the circulation passage. The acquiring acquires a characteristic indicating a relationship among a drive amount of the liquid feeding device, discharge information of the liquid discharged from the liquid discharge head, and a pressure detection value of the circulation passage. The changing changes, based on the characteristic acquired, at least one of a control parameter and a calculation expression used to control the liquid feeding device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
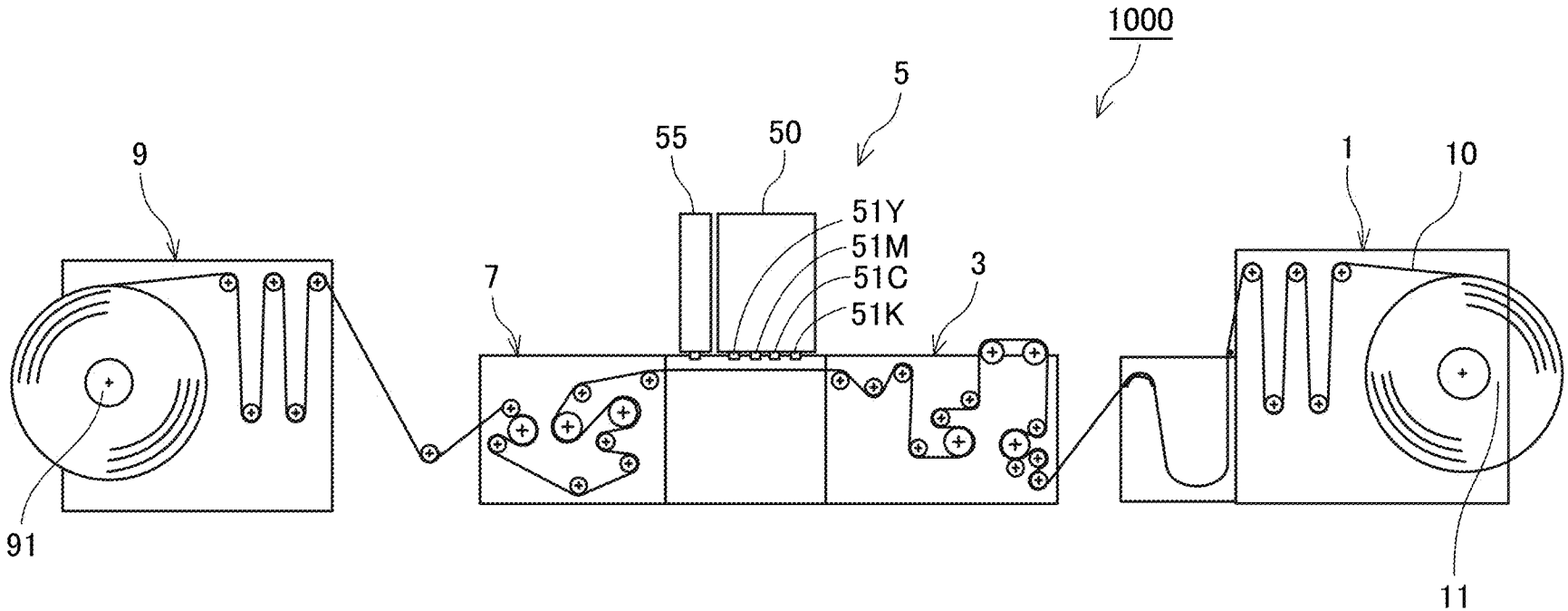
FIG. 1 is a schematic view illustrating an example of a printing apparatus as a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results. As used herein, the singular forms "a", "an", and "the" are intended to include the plural forms as well, unless the context clearly indicates otherwise.

Although the embodiments are described with technical limitations with reference to the attached drawings, such description is not intended to limit the scope of the disclosure and all of the components or elements described in the embodiments of this disclosure are not necessarily indispensable.

Figure 2:
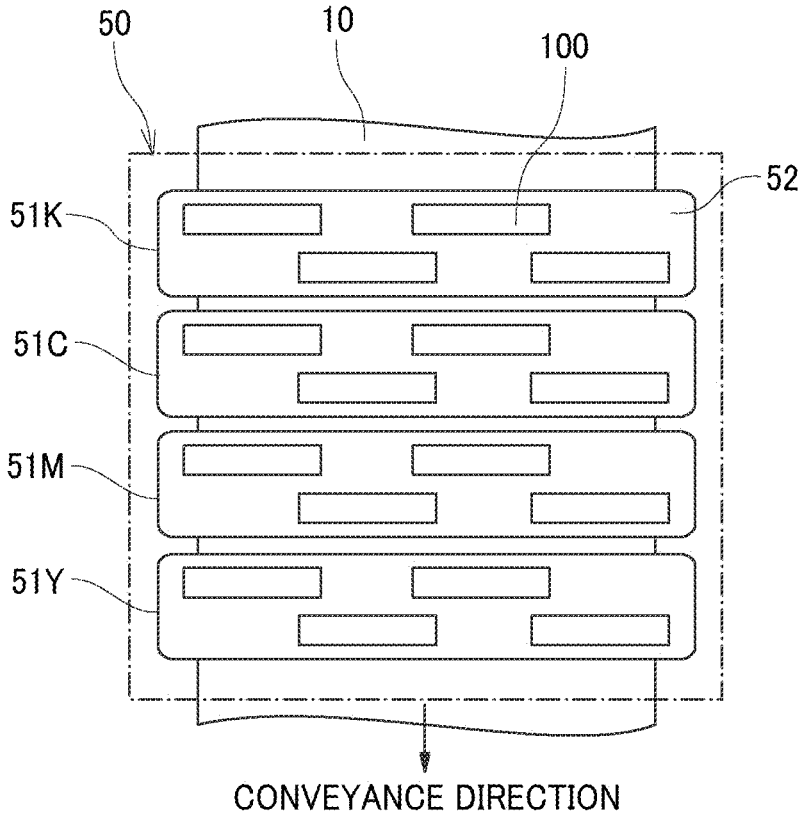
FIG. 2 is a plan view illustrating an example of a head device of the printing apparatus.

Below, embodiments of the present disclosure are described with reference to the accompanying drawings. Referring first to FIGS. 1 and 2, a description is given of an example of a printing apparatus as a liquid discharge apparatus according to an embodiment of the present disclosure. FIG. 1 is a schematic view of the printing apparatus as the liquid discharge apparatus according to the present embodiment. FIG. 2 is a plan view of an example of a head device of the printing apparatus.

A printing apparatus 1000 according to the present embodiment includes a feeder 1, a guide conveyor 3, a printer 5, a drier 7, and a carrier 9. The feeder 1 feeds a continuous medium 10 such as continuous paper. The guide conveyor 3 guides and conveys the continuous medium 10 fed from the feeder 1 to the printer 5. The printer 5 discharges liquid onto the continuous medium 10 to performs printing to form an image. The drier 7 dries the continuous medium 10. The carrier 9 draws out the continuous medium 10.

The continuous medium 10 is sent out from an original winding roller 11 of the feeder 1, is guided and conveyed by rollers of the feeder 1, the guide conveyor 3, the drier 7, and the carrier 9, and is wound up by a wind-up roller 91 of the carrier 9.

In the printer 5, the continuous medium 10 is conveyed while facing a head device 50 and a head device 55. An image is formed with liquid discharged from the head device 50, and post-processing is performed with a treatment liquid discharged from the head device 55.

In the head device 50, for example, full-line head arrays 51K, 51C, 51M, and 51Y for four colors (hereinafter referred to as the "head arrays 51" unless the colors distinguished from one another) are arranged in this order from the upstream side in the conveyance direction.

The head arrays 51K, 51C, 51M, and 51Y are liquid discharging units to discharge liquids of black K, cyan C, magenta M, and yellow Y, respectively, onto the continuous medium 10 being conveyed. The types and the number of colors are not limited to the above-described example.

As illustrated in FIG. 2, for example, each head array 51 has liquid discharge heads (also referred to simply as "heads") 100 arranged on a base member 52 in a staggered manner. However, the arrangement of the head arrays 51 is not limited to the staggered arrangement.

Figure 3:
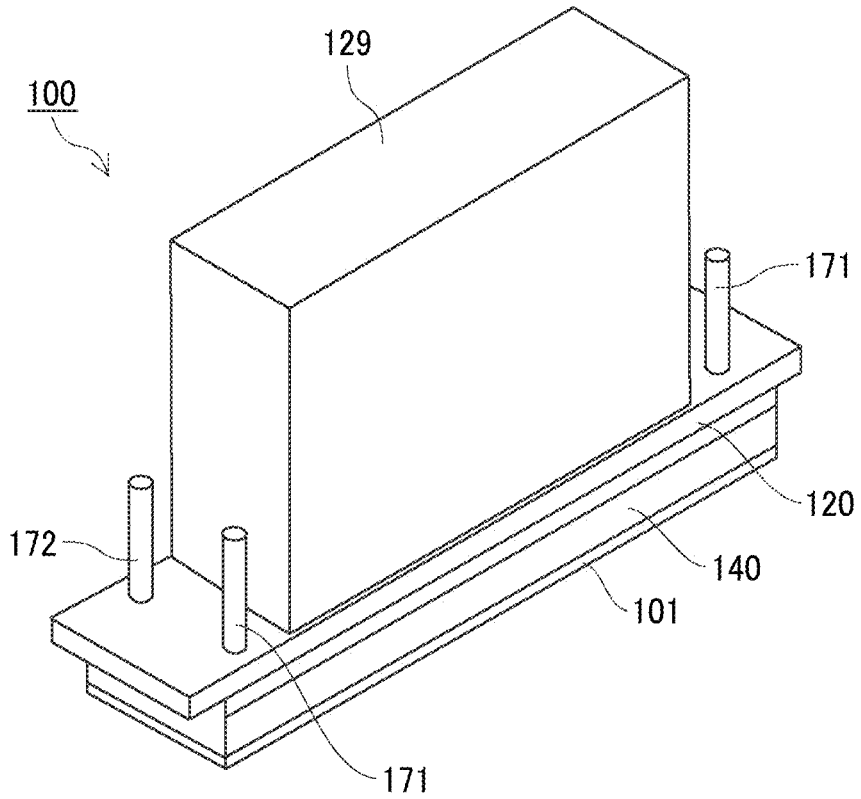
FIG. 3 is an external perspective view illustrating an example of a liquid discharge head.
Figure 4:
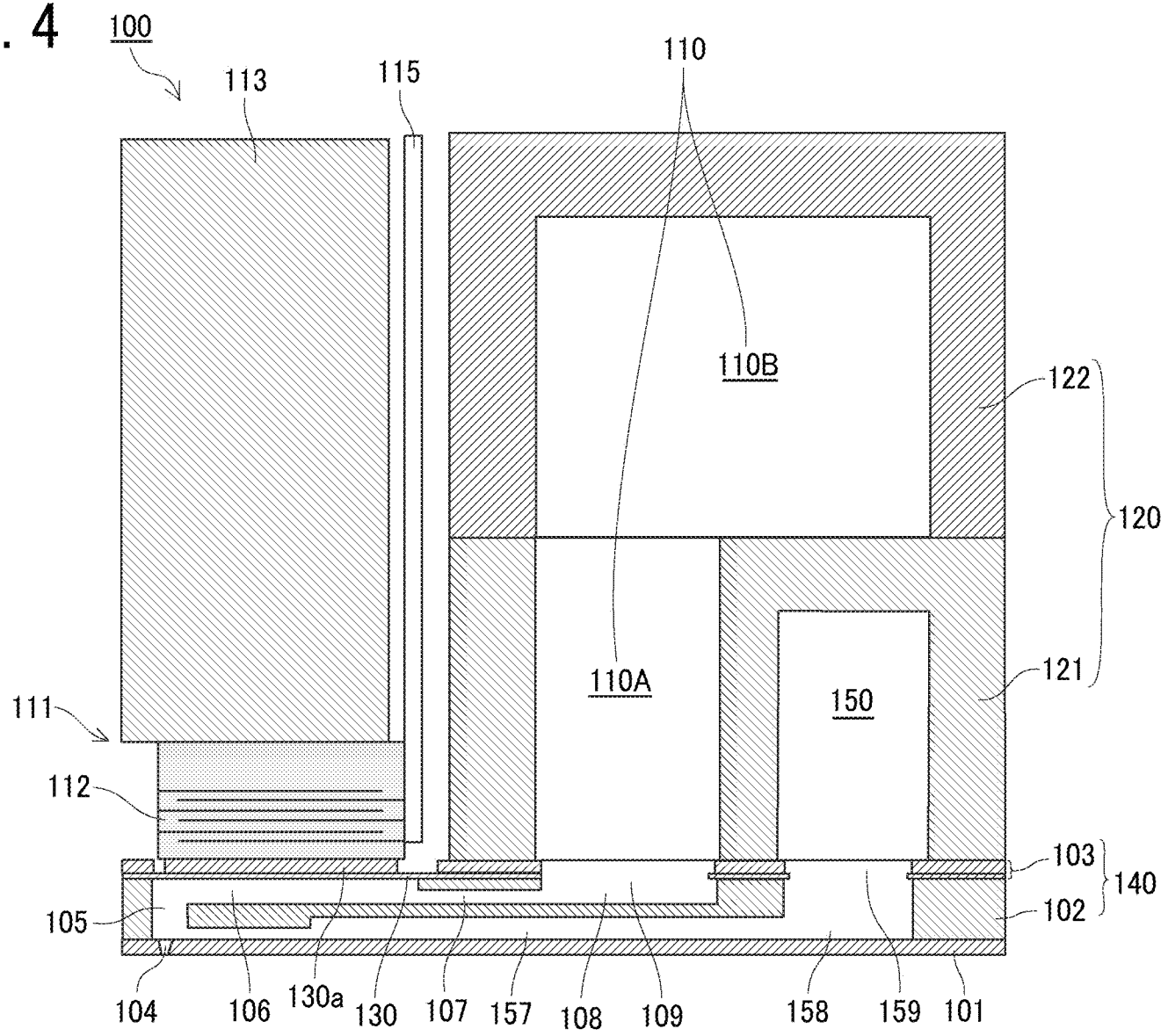
FIG. 4 is a cross-sectional view of the liquid discharge head in a direction perpendicular to a nozzle array direction.

Next, an example of a liquid discharge head is described with reference to FIGS. 3 and 4. FIG. 3 is an external perspective view of an example of the liquid discharge head. FIG. 4 is a cross-sectional view of the liquid discharge head in a direction orthogonal to a nozzle array direction in which nozzles are arrayed.

The liquid discharge head 100 is a flow-through head. A nozzle plate 101, a channel plate 102, and a diaphragm member 103 as a wall surface member are stacked and bonded in the liquid discharge head 100. The liquid discharge head 100 also includes a piezoelectric actuator 111 to displace a vibration region (diaphragm) 130 of the diaphragm member 103, a common channel member 120 also serving as a frame member of the liquid discharge head 100, and a cover 129. A portion formed with the channel plate 102 and the diaphragm member 103 is referred to as a channel member 140.

The nozzle plate 101 includes a plurality of nozzles 104 to discharge liquid.

In FIG. 4, the channel plate 102 forms a pressure chamber (individual liquid chamber) 106 communicating with the nozzle 104 via a nozzle communicating channel 105, an individual supply channel 107 also serving as a fluid restrictor communicating with the pressure chamber 106, and an intermediate supply channel 108 communicating with one or more individual supply channels 107. The nozzle communicating channel 105 is a channel communicating with both the nozzle 104 and the pressure chamber 106. The intermediate supply channel 108 is communicated with the common supply channel 110 via a supply-side opening 109 of the diaphragm member 103.

The diaphragm member 103 has a deformable vibration region (diaphragm) 130 forming a wall surface of the pressure chamber 106 of the channel plate 102. Here, the diaphragm member 103 has a two-layer structure (but is not limited to a two-layer structure) and includes a first layer forming a thin portion and a second layer forming a thick portion in this order from a side facing the channel plate 102. The first layer forms the deformable vibration region 130 at a portion corresponding to the pressure chamber 106.

The piezoelectric actuator 111 including an electromechanical transducer serving as a driving device (an actuator device or a pressure generator device) to deform the vibration region 130 of the diaphragm member 103 is disposed on a side of the diaphragm member 103 opposite a side facing the pressure chamber 106.

In the piezoelectric actuator 111, a piezoelectric member bonded on the base member 113 is grooved by half-cut dicing, to form a required number of columnar piezoelectric elements 112 at predetermined intervals in a comb shape.

Each of the piezoelectric elements 112 is bonded to a raised portion 130*a* that is an island-shaped thick portion in the vibration region 130 of the diaphragm member 103. A flexible wiring member 115 is connected to the piezoelectric element 112.

The common channel member 120 forms the common supply channel 110 and a common collection channel 150. The common supply channel 110 communicates with supply ports 171. The common collection channel 150 communicates with collection ports 172.

Here, the common channel member 120 includes a first common channel member 121 and a second common channel member 122. The first common channel member 121 is bonded to the channel member 140 at a side facing the diaphragm member 103. The second common channel member 122 is stacked on and bonded to the first common channel member 121.

The first common channel member 121 forms a downstream common channel 110A and a common collection channel 150. The downstream common channel 110A is part of the common supply channel 110 communicating with the intermediate supply channel 108. The common collection channel 150 communicates with the individual collection channel 157. The second common channel member 122 forms an upstream common channel 110B being a remaining portion of the common supply channel 110.

In FIG. 4, the channel plate 102 forms an individual collection channel 157 and an intermediate collection channel 158. The individual collection channel 157 includes a fluid restrictor communicating with each pressure chamber 6 via the nozzle communicating channel 105. The intermediate collection channel 158 communicates with one or more individual collection channels 157.

The intermediate collection channel 158 communicates with the common collection channel 150 via a collection-side opening 159 of the diaphragm member 103.

In the present embodiment, the common supply channel 110, the supply-side opening 109, the intermediate supply channel 108, and the individual supply channel 107 constitute a supply channel. The individual collection channel 157, the intermediate collection channel 158, and the collection-side opening 159 constitute a recovery channel.

In the liquid discharge head 100, for example, the voltage to be applied to the piezoelectric element 112 is lowered from a reference potential (intermediate potential) so that the piezoelectric element 112 contracts to pull the vibration region 130 of the diaphragm member 103 to increase the volume of the pressure chamber 106. As a result, liquid flows into the pressure chamber 106.

Then, the voltage to be applied to the piezoelectric element 112 is increased to expand the piezoelectric element 112 in the stacking direction, and the vibration region 130 of the diaphragm member 103 is deformed in a direction toward the nozzle 104 to reduce the volume of the pressure chamber 106. As a result, the liquid in the pressure chamber 106 is pressurized and discharged from the nozzle 104.

The liquid not discharged from the nozzle 104 passes by the nozzle 104, is collected from the individual collection channel 157, the intermediate collection channel 158, and the collection-side opening 159 to the common collection channel 150 and is supplied again from the common collection channel 150 to the common supply channel 110 through an external circulation passage.

Even when the liquid discharge operation of discharging the liquid from the nozzle 104 is not performed, the liquid is collected from the common supply channel 110 to the common collection channel 150 through the supply-side opening 109, the intermediate supply channel 108, the individual supply channel 107, the pressure chamber 106, the individual collection channel 157, the intermediate collection channel 158, and the collection-side opening 159, and is supplied again from the common collection channel 150 to the common supply channel 110 through the external circulation passage.

A method of driving the head is not limited to the above-described example (pull-push discharge), and pull discharge or push discharge may be performed in accordance with the way of applying the drive waveform.

Figure 5:
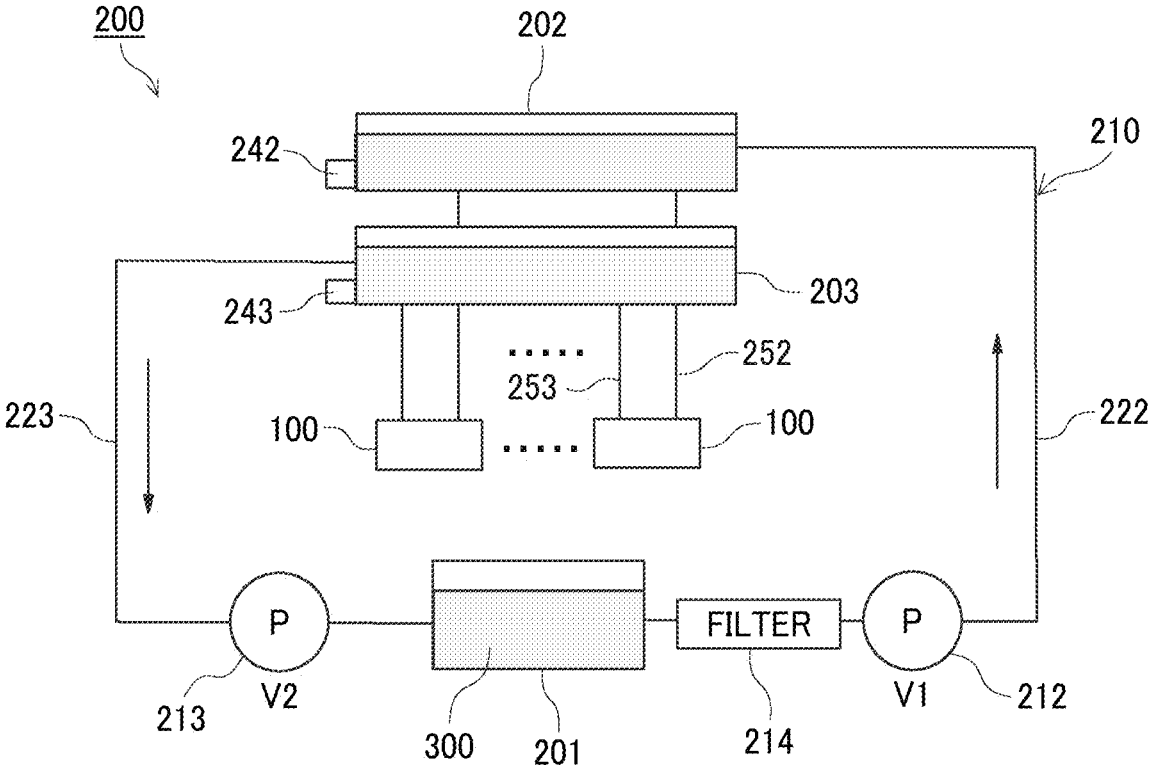
FIG. 5 is a schematic view of a liquid circulation device (liquid supply device) according to a first embodiment of the present disclosure.

Next, a third embodiment of the present disclosure is described with reference to FIG. 5. FIG. 5 is a schematic view of a liquid circulation device (liquid supply device) according to the fifth embodiment.

A liquid circulation device 200 according to the fifth embodiment circulates liquid for a plurality of circulatory liquid discharge heads 100 arranged in a line in a width direction (transverse direction) of the continuous medium 10.

The liquid circulation device 200 includes a main tank 201 that is a liquid tank serving as a liquid reservoir to store liquid 300 discharged from the heads 100. The liquid circulation device 200 also includes a supply tank 202, a collection tank 203, a first liquid feed pump (supply pump) 212 as a liquid feeding device, a second liquid feed pump (collection pump) 213 as another liquid feeding device, and a filter 214.

The main tank 201 and the supply tank 202 are connected via a liquid passage 222. The supply pump 212 and the filter 214 are disposed in the liquid passage 222. The collection tank 203 and the main tank 201 are connected via a liquid passage 223. The collection pump 213 is disposed in the liquid passage 223.

The supply ports 171 of the plurality of heads 100 are connected to the supply tank 202 via liquid passages 252. The collection ports 172 of the plurality of heads 100 are connected to the collection tank 203 via liquid passages 253.

Here, a circulation passage 210 is formed as a passage that starts from the main tank 201 and returns to the main tank 201 through the liquid passage 222, the supply tank 202, the liquid passages 252, the heads 100, the liquid passages 253, the collection tank 203, and the liquid passage 223.

Each of the supply tank 202 and the collection tank 203 is sealed in a state in which each of the supply tank 202 and the collection tank 203 contains air inside. Therefore, as the amount of liquid in the supply tank 202 or the collection tank 203 increases due to an increase in the amount of liquid supplied or a decrease in the amount of liquid collected, the pressure in the supply tank 202 or the collection tank 203 increases. By contrast, as the amount of liquid in the supply tank 202 or the collection tank 203 decreases due to a decrease in the amount of liquid supplied or an increase in the amount of liquid collected, the pressure in the supply tank 202 or the collection tank 203 decreases.

That is, the pressure in each of the supply tank 202 and the collection tank 203 can be changed by changing the drive amount of the supply pump 212 or the collection pump 213 and adjusting the liquid feed amount (the supply amount or the collection amount).

Adjusting the pressure in the supply tank 202 to be higher than the pressure in the collection tank 203 allows the liquid to flow in the heads 100 and circulate in the circulation passage 210. That is, the supply pump 212 and the collection pump 213 constitute a unit to generate the pressure for circulating the liquid in the circulation passage 210.

The supply pump 212 and the collection pump 213, which are examples of the liquid feeding devices, are supplied with power from a power supply device, and change the liquid feed amount with a change in drive amount in accordance with the magnitude of the control voltage to be input.

The supply tank 202 is provided with a pressure sensor 242 as a first pressure detector to detect the pressure in the supply tank 202. The collection tank 203 is provided with a pressure sensor 243 as a second pressure detector to detect the pressure in the collection tank 203.

In the present embodiment, the pumps are used as the liquid feeding devices. However, in some embodiments, for example, valves may be provided instead of the pumps to control the liquid feed amount.

Figure 6:
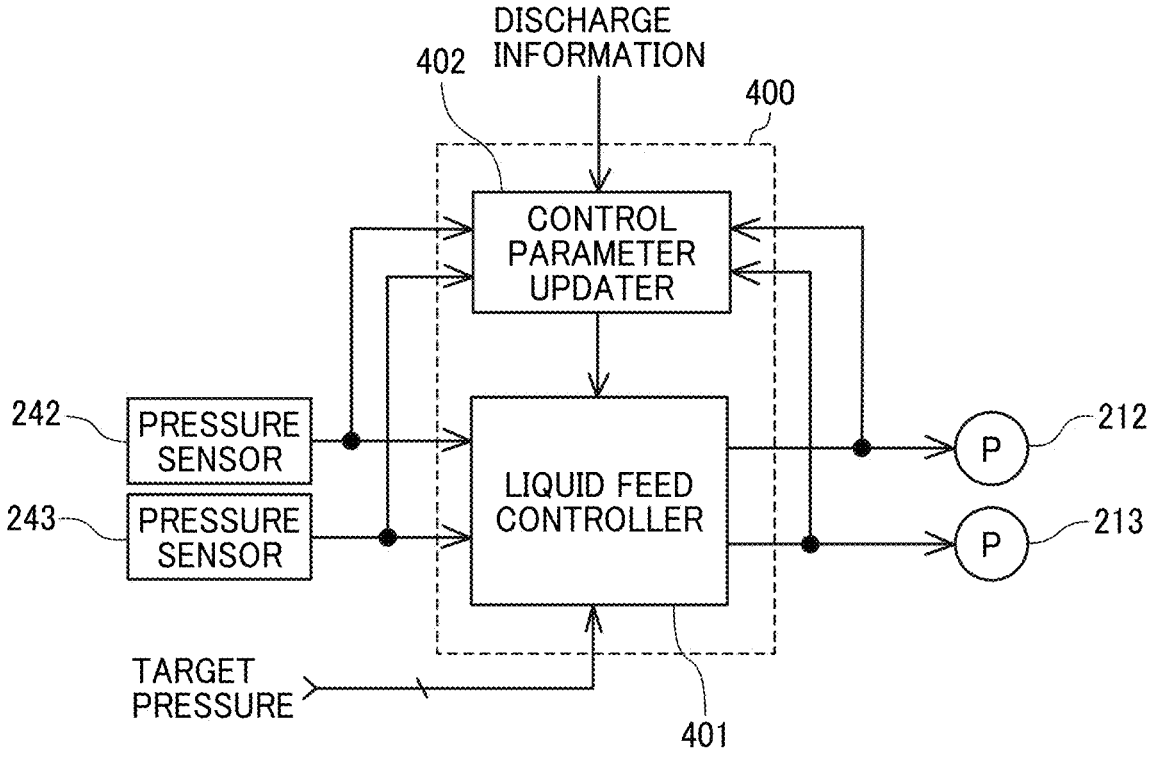
FIG. 6 is a block diagram of a controller related to liquid feed control by a supply pump and a collection pump.

Next, a controller relating to liquid feed control by the supply pump 212 and the collection pump 213 is described with reference to FIG. 6.

The controller 400 is control circuitry to control the supply pump 212 and the collection pump 213, which are examples of the liquid feeding devices, and includes a liquid feed controller 401 and a control parameter updater 402. The controller 400 includes a microcomputer such as a central processing unit (CPU), a read only memory (ROM), a random access memory (RAM), and an input-and-output (I/O) unit.

A pressure detection value of the supply tank 202, which is a detection result of the pressure sensor 242, and a pressure detection value of the collection tank 203, which is a detection result of the pressure sensor 243, are input to the liquid feed controller 401. A pressure target value is given to the liquid feed controller 401.

The liquid feed controller 401 compares the pressure detection value with the pressure target value and changes at least one of a control voltage V1 for the supply pump 212 and a control voltage V2 for the collection pump 213 according to a difference between the pressure detection value and the pressure target value. Accordingly, the drive amounts of the supply pump 212 and the collection pump 213 change in accordance with the magnitudes of the input control voltages V1 and V2 (collectively referred to as "control voltages V"), thus changing the liquid feed amounts of the supply pump 212 and the collection pump 213.

Here, as a method of calculating the control voltages V for example, there is a method in which the control voltage V1 for the supply pump 212 is made constant and the control voltage V2 for the collection pump 213 is increased or decreased by a certain value. There is also a method of calculation using proportional-integral-differential (PID) control. When the PID control is performed, the liquid feed controller 401 may be implemented by an analog electronic circuit.

The calculation expression of the control voltages V and the control parameters used for the calculation are set in advance so that the pressure variations in liquid discharge are minimized.

The control parameter updater 402 inputs the drive amounts (control voltages V1 and V2) for the supply pump 212 and the collection pump 213, which are examples of the liquid feeding devices, discharge information given as print information input to the printing apparatus 1000 by a user, and pressure detection values of the pressure sensor 242 and the pressure sensor 243.

Here, the control parameter updater 402 acquires characteristic information indicating the relationship between the drive amount and the discharge information (for example, the liquid discharge amount) and the pressure detection value.

The control parameter updater 402 changes, based on the acquired characteristic information, control parameters used by the liquid feed controller 401 to control the supply pump 212 and the collection pump 213. For example, when the supply pump 212 and the collection pump 213 are driven by the PID control, Kp (proportional constant), Ki (integral constant), Kd (differential constant), and the like are changed. Instead of or in addition to changing the control parameters, the calculation expression may be changed.

Figure 7:
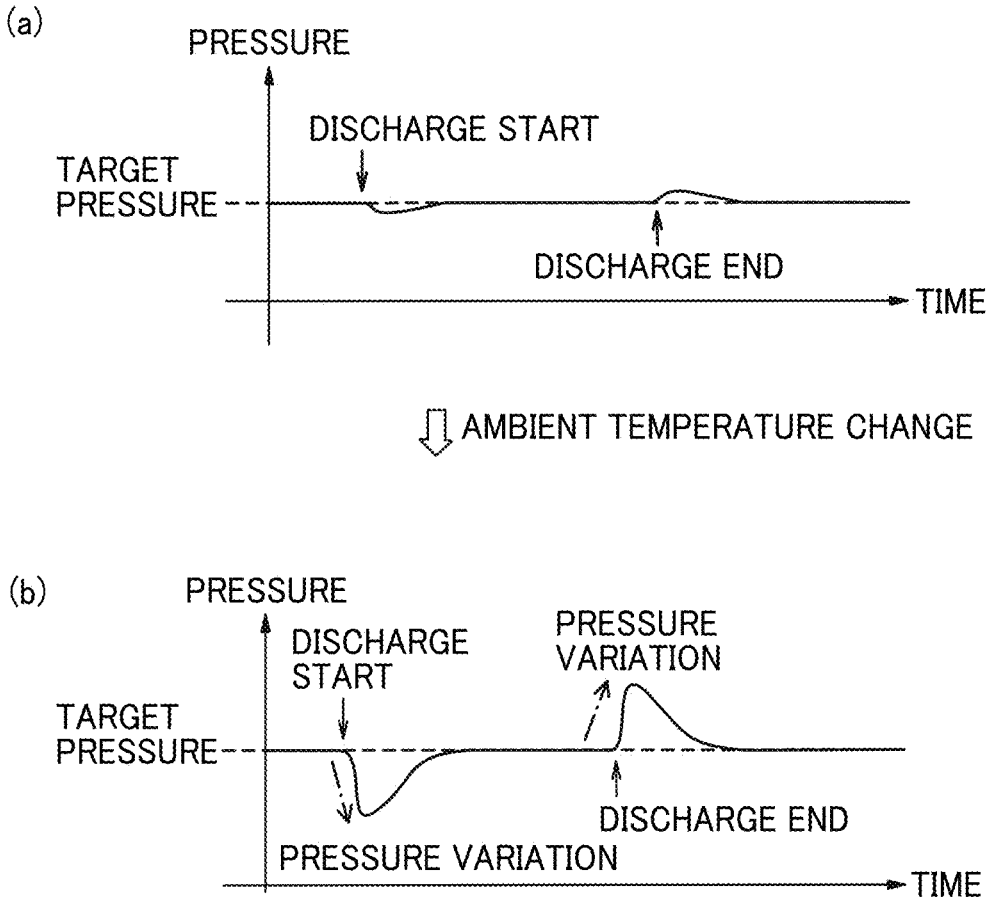
FIG. 7 includes graphs illustrating a case in which a temperature change occurs during the liquid feed control of the liquid feeding device.

Next, with reference to FIG. 7, a description is given of a case where a temperature change arises when the liquid feed control of the liquid feeding device is performed. Part (a) and part (b) of FIG. 7 are graphs of examples of the temperature change.

In the liquid circulation device, when an environmental condition, for example, an ambient temperature, changes, the relationship between the liquid supply amount by the liquid supply device and pressure variation and the relationship between liquid discharge and pressure variation change.

For example, in part (a) of FIG. 7, the liquid feeding device is driven and controlled by predetermined control parameters to control the liquid feed amount. Thus, the pressure of the supply tank 202 and the collection tank 203 are controlled to be the target pressure. Such a configuration can reduce the pressure variations accompanying the start and end of the liquid discharge from the head 100.

In such a state, for example, when the ambient temperature changes, a physical property value such as the viscosity of the liquid changes. Accordingly, even if the liquid feeding device is driven and controlled by predetermined control parameters to control the liquid feed amount to be constant, the pressure loss caused when the liquid passes through the circulation passage changes. As a result, as illustrated in part (b) of FIG. 7, the pressure variations accompanying the start and end of the liquid discharge from the head 100 become large, that is, the pressure variations may not be reduced, thus causing a change in the discharge amount.

Therefore, the calculation expression of the control voltages used for controlling the liquid feeding device and the control parameters used for the calculation expression are preferably changed according to the change of the environmental condition.

In addition, the relationship between the drive amount of the liquid feeding device and the pressure variation and the relationship between the discharge amount and the pressure variation also change due to component deterioration over time or the like.

For example, in a case of an apparatus, such as a commercial or industrial inkjet apparatus, which is continuously operated for a long time of several hours to several days, the liquid feeding performance of a pump serving as a liquid feeding device decreases over time. Therefore, as in the case where an environmental change occurs, the relationship between the drive amount of the liquid feeding device and the pressure variation and the relationship between the discharge amount and the pressure variation change.

The relationship between the drive amount of the liquid feeding device and the pressure variation and the relationship between the discharge amount and the pressure variation also change depending on the type of liquid and the liquid discharge head.

Besides the water-soluble ink, for example, ultraviolet curable ink (UV ink), fluorescent ink, sedimentation ink, or the like is used as the liquid. In addition, the size of droplets discharged from the liquid discharge head may vary. Since the pressure loss arising when the liquid passes through the circulation passage varies depending on, e.g., the viscosity of the liquid and the passage diameter inside the head, the relationship between the drive amount of the liquid feeding device and the pressure variation and the relationship between the discharge amount and the pressure variation vary depending on the liquid to be used and the liquid discharge head.

Figure 8:
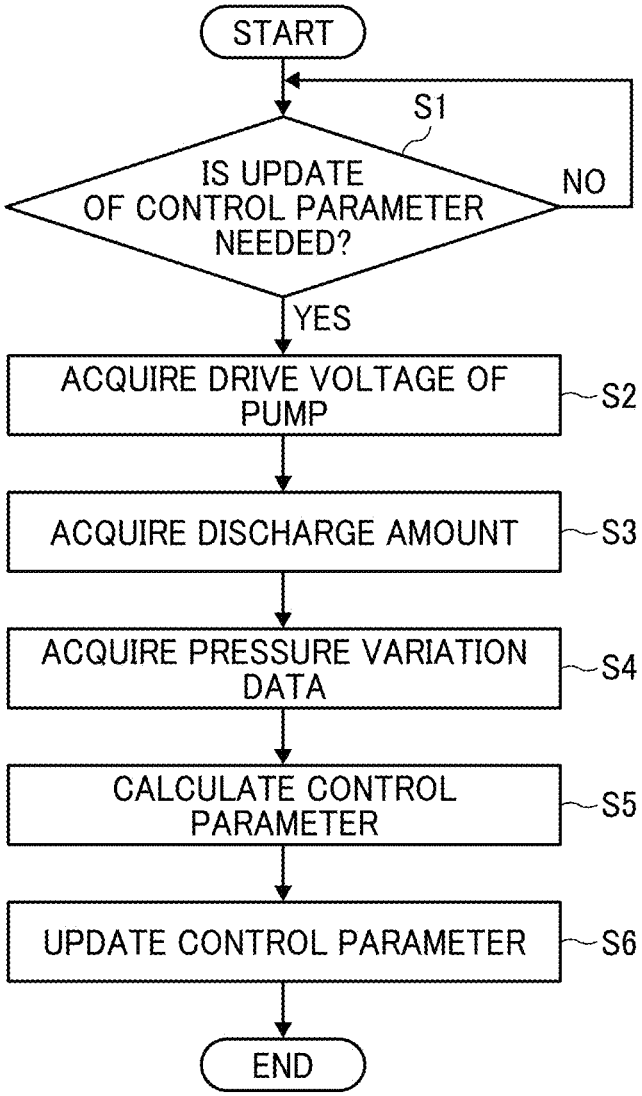
FIG. 8 is a flowchart of a control parameter updating process by a control parameter updater according to an embodiment of the present disclosure.

Next, a control parameter updating process by the control parameter updater in an embodiment of the present disclosure is described with reference to the flowchart of FIG. 8.

The control parameter updater 402 determines whether update of control parameters is need (step S1, hereinafter simply referred to as "S1").

For example, when environmental conditions (ambient temperature and ambient humidity) change by a predetermined value or more, the control parameter updater 402 determines that the update is needed. When the component deterioration over time due to the continuous operation is predicted from data of various sensors during operation of the printing apparatus, the control parameter updater 402 determines that the update is needed. Further, when the type of liquid to be used or a component such as the liquid discharge head is changed by a user, the control parameter updater 402 determines that the update is needed.

Here, when the control parameter updater 402 determines that the update is needed, the control parameter updater 402 acquires the respective drive voltages corresponding to the drive amounts of the supply pump 212 and the collection pump 213 as the liquid feeding devices (S2). The control parameter updater 402 acquires the discharge amount (liquid consumption amount by discharge) from the discharge information (S3). The control parameter updater 402 further acquires pressure variation data obtained from the pressure detection values from the pressure sensors 242 and 243 at that time (S4). The acquired information (characteristic information) is stored in an internal storage device.

The control parameter updater 402 calculates the calculation expression and the control parameters based on the acquired characteristic information (S5) and updates the calculation expression and the control parameters of the liquid feed controller 401 (S6).

That is, in the liquid circulation method according to the present embodiment, the drive amount of the liquid feeding device and the pressure detection value of the circulation passage are acquired, and the control parameters used for controlling the liquid feeding device are changed based on the acquired drive amount and pressure detection value.

Figure 9A:
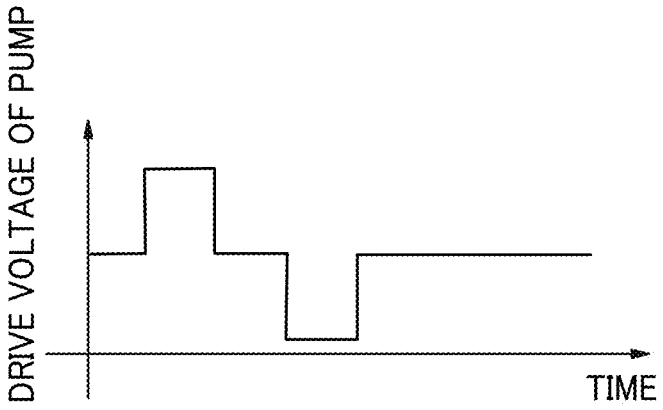
FIGS. 9A to 9C are graphs illustrating examples of data acquisition of a drive amount, discharge information, and pressure variation data in control parameter update control.
Figure 9B:
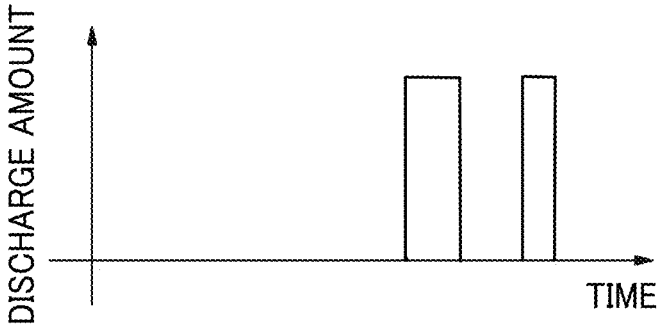
Figure 9C:
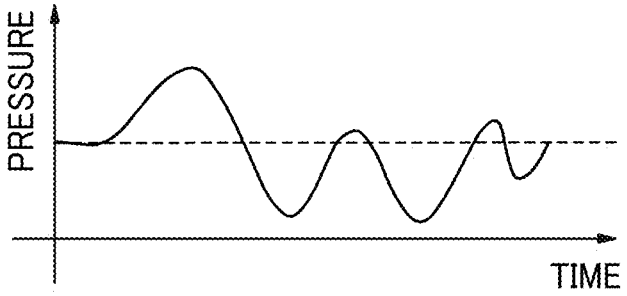

Next, examples of data acquisition of the drive amount, the discharge information, and the pressure variation data in the control parameter update control are described with reference to FIGS. 9A to 9C. FIGS. 9A to 9C are graphs illustrating examples of data acquisition of the drive amount, the discharge information, and the pressure variation data in the control parameter update control.

When the control parameter updater 402 determines that update of the control parameters is needed, as illustrated in FIG. 9A, the pump drive voltage of each of the supply pump 212 and the collection pump 213 is changed to change the drive amount, and the pressure variation values are acquired from the pressure detection values detected by the pressure sensor 242 and the pressure sensor 243 at that time.

The pressure propagation from the supply pump 212 and the collection pump 213 to the pressure sensor 242 and the pressure sensor 243, respectively, is affected by a response delay and a pressure loss due to friction between the liquid and a wall surface of, e.g., a tube forming a passage. When such characteristics change, appropriate control parameters change.

Therefore, the relationship between the drive amount and the pressure variation value is actually measured, thus allowing grasp of a characteristic in acquisition of the drive amount and the pressure variation value (the relationship between the drive amount and the pressure variation value).

As illustrated in FIG. 9B, the liquid is discharged from the liquid discharge head 100, and data of pressure variations due to the liquid discharge are acquired in the same manner. Thus, the characteristic (the relationship between the discharge amount and the pressure variation value) is grasped.

Then, a control parameter corresponding to the acquired characteristic is calculated.

In the above-described data acquisition operation, an operation of discharging liquid from the head 100 (liquid discharge operation), for example, a printing operation is stopped, the supply pump 212 and collection pump 213 are driven in a predetermined manner, and pressure responses are measured.

Accordingly, the characteristics can be acquired from desired data, thus allowing the control parameters to be calculated with high accuracy.

In addition, the pressure response when a predetermined discharge is performed is also measured, and the control parameters are also corrected from the measurement result.

Alternatively, without stopping the liquid discharge operation (printing operation), data of the drive amount and the pressure variation values of the supply pump 212 and the collection pump 213 during actual operation may be acquired to acquire characteristics and calculate control parameters.

Such a configuration can reduce the influence of changes in environmental conditions, deterioration of components over time, liquid type, head replacement, and the like without causing downtime.

Alternatively, the discharge amount and the pressure variation in actual operation are also measured, and the control parameters are corrected from the measurement results.

As in the present embodiment, in a configuration in which a plurality of liquid feeding devices (the supply pump 212 and the collection pump 213) and a plurality of pressure detectors (the pressure sensor 242 and the pressure sensor 243) are provided, for example, the following data acquisition is performed.

That is, the following data are acquired: (1) data (pressure detection value) of the pressure sensor 242 of the supply tank 202 and data (pressure detection value) of the pressure sensor 243 of the collection tank 203 when the drive amount of the supply pump 212 is changed, (2) data (pressure detection value) of the pressure sensor 242 of the supply tank 202 and data (pressure detection value) of the pressure sensor 243 of the collection tank 203 when the drive amount of the collection pump 213 is changed, and (3) data (pressure detection value) of the pressure sensor 242 of the supply tank 202 and data (pressure detection value) of the pressure sensor 243 of the collection tank 203 when liquid discharge is performed.

For example, when PID control is performed by the liquid feed controller 401, the three control parameters of the P term, the I term, and the D term are updated from the frequency characteristics of control targets acquired in the above-described (1) to (3) by using a general control parameter design method (maximization of the crossing frequency, a limit sensitivity method, or the like).

Specifically, for example, the control parameters are calculated as follows. The dead time L, the steady gain K, and the time constant T of the system are identified from the characteristic values described above, and the PID control parameters Kp, Ki, and Kd are calculated by the following expressions. $Kp=0.6/RL$, $Ki=Kp/T$, and $Kd=Kp\times0.5$, where $R=K/L$ From the expressions, for example, when $L=0.01$ [s], $K=1$, and the time constant is 0.5 [s], the PID control parameters Kp, Ki, and Kd are calculated as $Kp=30$, $Ki=60$, and $Kd=0.15$.

Figure 10:
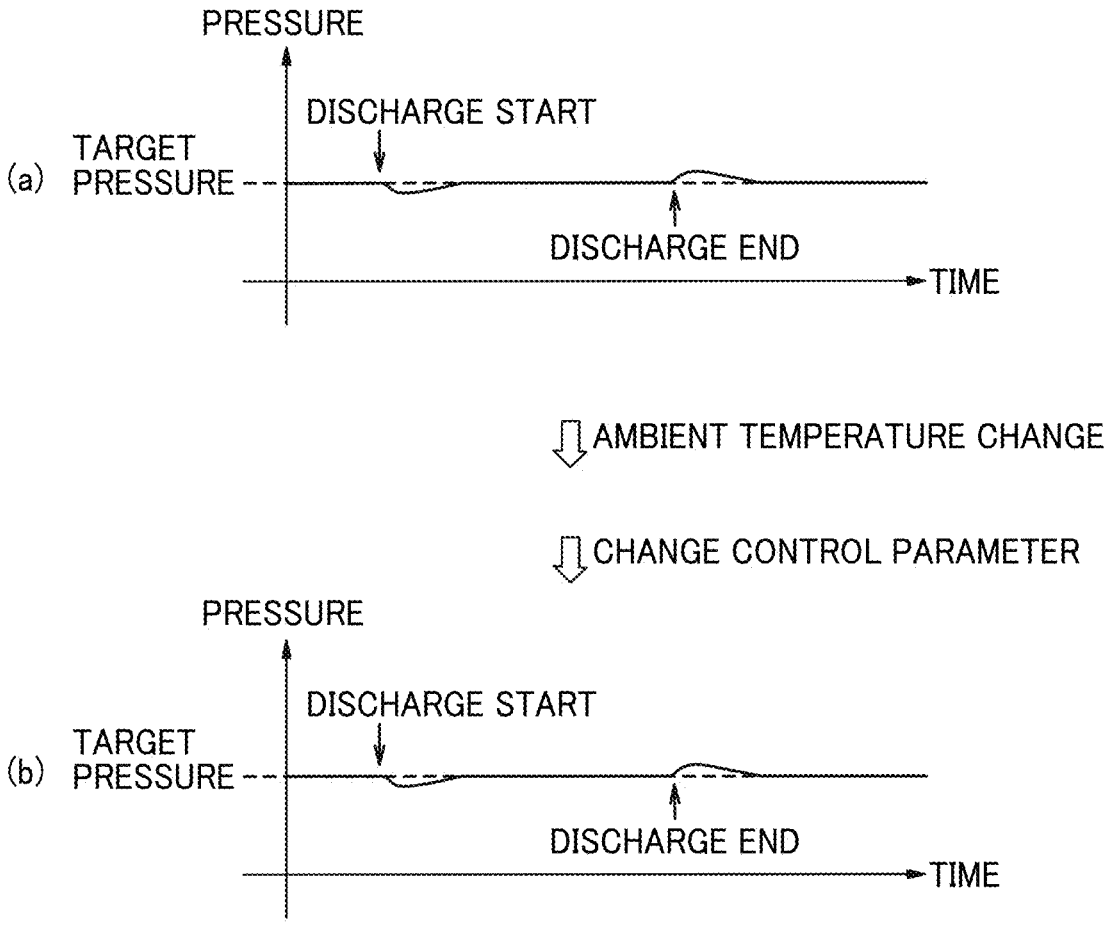
FIG. 10 includes graphs illustrating an effect of the control parameter update control in the first embodiment.

Next, an effect of the present embodiment are described with reference to FIG. 10, Part (a) and part (b) of FIG. 10 are graphs illustrating an effect of the control parameter update control in the present embodiment.

As illustrated in part (a) of FIG. 10, even when the ambient temperature changes from a state in which the pressure is controlled to be the target pressure, updating the control parameters according to the present embodiment can reduce the pressure variations accompanying the liquid discharge as illustrated in FIG. 10B, thus allowing stable liquid circulation.

Accordingly, for example, mixing of bubbles into the head or dripping of liquid from the head can be reduced or prevented. The discharge amount discharged from the head is also stabilized, thus enhancing the image quality and the fabricating quality.

Whether the control parameters are updated as in the present embodiment can be determined as follows, for example. That is, before and after the control parameters are estimated to have been changed, the operation of the controller can be determined by regression analysis (machine learning, system identification, etc.) from the detection value of the pressure (information entering the liquid feed controller) and the time change data of the drive voltage of the pump (output of the liquid feed controller) at that time. For example, in the case of PID control, parameters P, I, and D, which are parameters of the controller, can be identified from the information.

Figure 11:
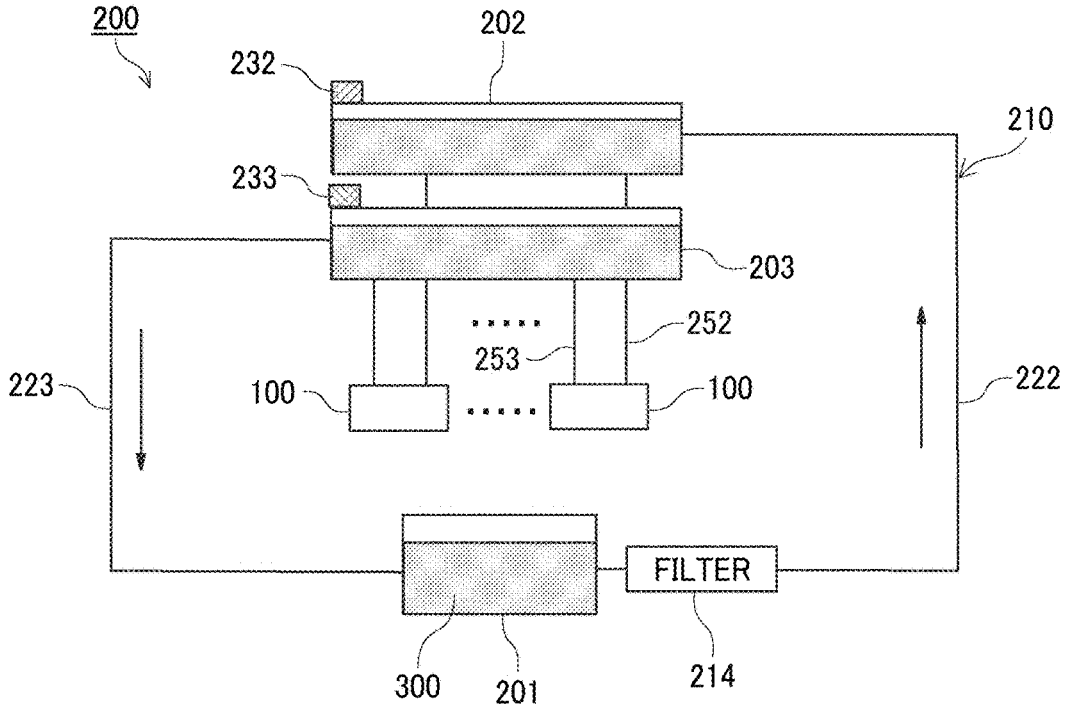
FIG. 11 is a schematic view of a liquid circulation device according to a second embodiment of the present disclosure.

Next, a second embodiment of the present disclosure is described with reference to FIG. 11. FIG. 11 is a schematic view of the liquid circulation device according to the third embodiment.

In the present embodiment, the liquid circulation device 200 includes a pressure adjuster 232 and a pressure adjuster 233 as liquid feeding devices. The pressure adjuster 232 such as a pump or a valve is capable of changing the amount of air in the supply tank 202. The pressure adjuster 233 such as a pump or a valve is capable of changing the amount of air in the collection tank 203.

The pressure adjuster 232 and the pressure adjuster 233 set the pressures of the supply tank 202 and the collection tank 203, respectively, to be lower than the pressure of the main tank 201, thus allowing the liquid to be drawn into the supply tank 202 and fed.

Figure 12:
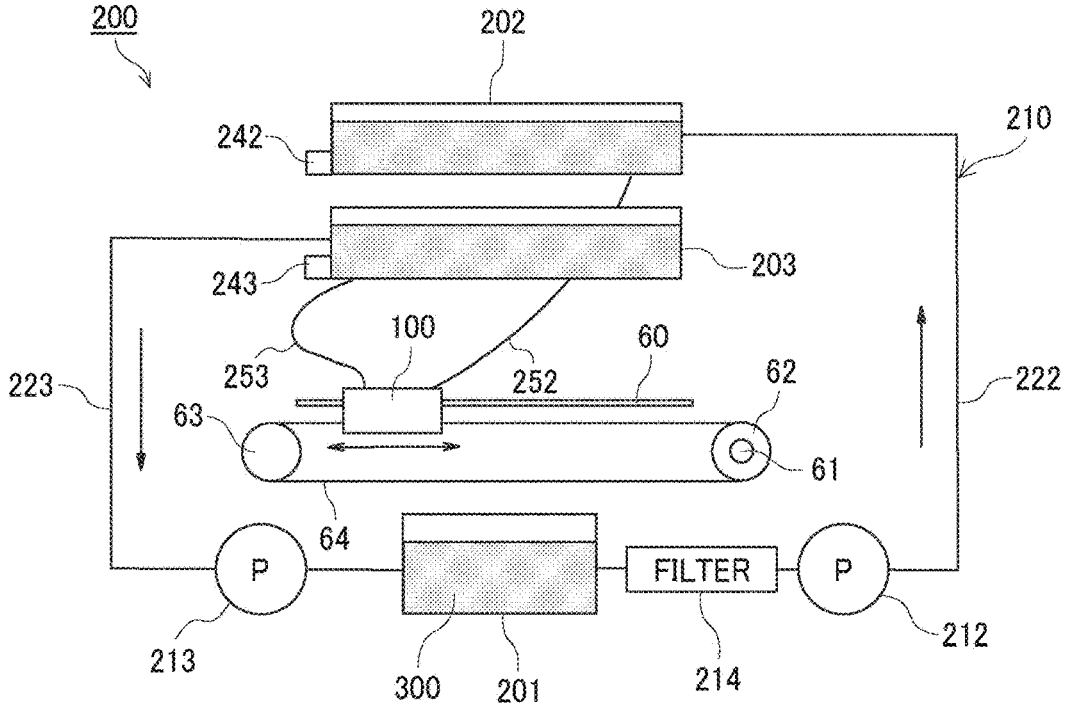
FIG. 12 is a schematic view of a liquid circulation device according to a third embodiment of the present disclosure.

Next, a third embodiment of the present disclosure is described with reference to FIG. 12. FIG. 12 is a schematic view of the liquid circulation device according to the third embodiment.

In the present embodiment, the head 100 is mounted on, e.g., a carriage, is movably held by a guide member 60, and is reciprocally moved by a pulling force generated by a timing belt 64 stretched between a driving pulley 62, which is driven and rotated by a drive source 61, and a driven pully 63.

The head 100 and the supply tank 202 are connected by a liquid passage 252 formed with a flexible tube or the like. The head 100 and the collection tank 203 are connected by a liquid passage 253 formed with a flexible tube or the like.

In such a manner, the above-described embodiments can be applied to a serial-type liquid discharge apparatus in which the head 100 reciprocally moves.

In the present disclosure, the "liquid" to be discharged is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. More specifically, the liquid to be discharged is a solution, a suspension liquid, an emulsion, or the like containing a solvent such as water or an organic solvent, a colorant such as a dye or a pigment, a function-imparting material such as a polymerizable compound, a resin, or a surfactant, a biocompatible material such as deoxyribonucleic acid (DNA), amino acid, protein, or calcium, or an edible material such as a natural pigment, which can be used, for example, for an inkjet ink, a surface treatment liquid, a liquid for forming a constituent element of an electronic element or a light emitting element or an electronic circuit resist pattern, a three-dimensional modeling material liquid, or the like.

The term "liquid discharge head" signifies liquid discharge heads employing, as an energy source to generate energy to discharge liquid, a piezoelectric actuator (a laminated piezoelectric element or a thin-film piezoelectric element), a thermal actuator that employs an electrothermal transducer element, such as a heat element, or an electrostatic actuator including a diaphragm and opposed electrodes.

The term "liquid discharge apparatuses" signifies apparatuses that drive a liquid discharge head to discharge liquid. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can be adhered. The liquid discharge apparatus may further include a pretreatment apparatus to coat a treatment liquid onto the material, and a post-processing apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The apparatus for discharging liquid is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media such as a paper sheet, recording paper, and a recording sheet of paper, film, and cloth, electronic components such as an electronic substrate and a piezoelectric element, and media such as a powder layer, an organ model, and a testing cell. The "material on which liquid can be adhered" includes any material on which liquid adheres unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" includes an apparatus in which the liquid discharge head and the material to which the liquid may adhere move relative to each other; however, this is not limited to such an apparatus. The liquid discharge apparatus may be, for example, a serial-type apparatus to move a liquid discharge head relative to a sheet material or a line-type apparatus that does not move a liquid discharge head relative to a sheet material.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid circulation device comprising:

a circulation passage through which liquid circulates to be supplied to and collected from a circulatory liquid discharge head;

a liquid feeding device configured to circulate the liquid through the circulation passage;

a pressure sensor configured to detect a pressure of the circulation passage; and control circuitry configured to:

acquire a characteristic indicating a relationship among a drive amount of the liquid feeding device, discharge information of the liquid discharged from the liquid discharge head, and a pressure detection value of the circulation passage; and change, based on the characteristic acquired, at least one of a control parameter and a calculation expression used to control the liquid feeding device, wherein the control circuitry is configured to change the at least one of the control parameter and the calculation expression when at least one of an ambient temperature and an ambient humidity of an environmental condition in which the liquid circulation device is operating changes by a predetermined value or more.

2. The liquid circulation device according to claim 1, wherein the control circuitry is configured to change the at least one of the control parameter and the calculation expression when deterioration of a component of the liquid circulation device over time is predicted.

3. The liquid circulation device according to claim 1, wherein the control circuitry is configured to change the at least one of the control parameter and the calculation expression when at least one of the liquid, the liquid discharge head, and a component of the liquid feeding device is changed.

4. The liquid circulation device according to claim 1, wherein the control circuitry is configured to acquire the characteristic from a pressure variation detection value detected by the pressure sensor when a liquid discharge operation is stopped and the liquid feeding device is driven by a predetermined drive amount.

5. The liquid circulation device according to claim 4, wherein the control circuitry is configured to acquire the characteristic from the pressure variation detection value when the liquid discharge operation is stopped and a predetermined amount of liquid is discharged from the liquid discharge head.

6. The liquid circulation device according to claim 1, wherein the control circuitry is configured to acquire the characteristic from a liquid feed amount of the liquid feeding device and the pressure detection value when a liquid discharge operation is performed.

7. The liquid circulation device according to claim 6, wherein the control circuitry is configured to acquire the characteristic from a discharge amount and the pressure detection value during the liquid discharge operation.

8. A liquid discharge apparatus comprising:

the liquid circulation device according to claim 1; and the liquid discharge head.

9. The liquid discharge apparatus according to claim 8, wherein the liquid discharge head is configured to discharge the liquid to fabricate a three-dimensional object.

* * * * *